US007744707B2

(12) United States Patent
Brunson

(10) Patent No.: US 7,744,707 B2
(45) Date of Patent: Jun. 29, 2010

(54) DEEP CRYOGENIC TEMPERING OF BRAKE COMPONENTS

(75) Inventor: Robert Woolley Brunson, Pleasant View, UT (US)

(73) Assignee: Brian Morrison, Shreveport, LA (US)

( * ) Notice: Subject to any disclaimer, the term of this patent is extended or adjusted under 35 U.S.C. 154(b) by 1454 days.

(21) Appl. No.: 09/844,526

(22) Filed: Apr. 27, 2001

(65) Prior Publication Data

US 2002/0179204 A1 Dec. 5, 2002

(51) Int. Cl.
*C21D 6/04* (2006.01)

(52) U.S. Cl. ..... 148/578; 148/577; 62/64; 62/65; 62/121

(58) Field of Classification Search ..... 148/577, 148/578; 62/64, 65, 121
See application file for complete search history.

(56) References Cited

U.S. PATENT DOCUMENTS 5,447,035 A * 9/1995 Workman et al. ..... 62/62

5,865,913 A * 2/1999 Paulin et al. ..... 148/577

OTHER PUBLICATIONS

Metals Handbook, 1948 Edition, The American Society for Metals, 1948, pp. 613-630.*

* cited by examiner

*Primary Examiner*—Sikyin Ip
(74) *Attorney, Agent, or Firm*—Keisling & Pieper PLC; Meredith K. Lowry; Trent C. Keisling

(57) ABSTRACT

A deep cryogenic tempering process for brake components such as rotors and drums is provided, wherein the unique processing profile is dependent on properties of the specific brake components. The process comprises the steps of placing a brake component at a temperature within a cryogenic processing chamber, cooling the brake component at a descent rate until the brake component temperature is approximately −300° F., maintaining the brake component temperature at −300° F. for a stay time, raising the temperature of the brake component to approximately −300° F. at an ascent rate, maintaining the temperature of the brake component at 300° F. for a post temper time, and lowering the temperature of the brake component to room temperature at a cool down rate.

5 Claims, 3 Drawing Sheets

| Time (HR) | Temp (F) |
|---|---|
| Data Poin Time | Temp |
| 0 0.0000 | 100.0 |
| 1 4.8077 | -100.0 |
| 2 5.7692 | -150.0 |
| 3 6.7308 | -200.0 |
| 4 7.6923 | -250.0 |
| 5 8.6538 | -275.0 |
| 6 9.6154 | -290.0 |
| 7 11.5385 | -300.0 |
| 8 35.5385 | -300.0 |
| 9 50.0000 | -100.0 |

| Time (MIN) | Temp (F) |
|---|---|
| 0.00 | 70.0 |
| 15.00 | 280.0 |
| 17.50 | 290.0 |
| 20.00 | 300.0 |
| 80.00 | 300.0 |
| 100.00 | 70.0 |
| 160.00 | 70.0 |
| 175.00 | 280.0 |
| 177.50 | 290.0 |
| 180.00 | 300.0 |
| 240.00 | 300.0 |
| 260.00 | 70.0 |
| 320.00 | 70.0 |
| 335.00 | 280.0 |
| 337.50 | 290.0 |
| 340.00 | 300.0 |
| 400.00 | 300.0 |
| 420.00 | 70.0 |

DEEP CRYOGENIC TEMPERING OF BRAKE COMPONENTS

FIELD OF THE INVENTION

The present invention relates generally to deep cryogenic tempering, and more particularly to deep cryogenic tempering processes for brake components to produce improved molecular structures and enhanced structural properties.

BACKGROUND OF THE INVENTION

Deep cryogenic tempering generally involves subjecting parts or components to temperatures in the range of approximately −250° F. to −350° F., typically through the introduction of a cryogenic liquid such as nitrogen into a cryogenic processing chamber. After the components are held at deep cryogenic temperatures for a specific period of time, the components are returned to ambient temperatures. Further, the components often undergo a heat treatment after the cryogenic process, followed by a return to ambient temperatures. As a result, specific deep cryogenic tempering can greatly enhance specific properties of the components as more fully described below.

Known applications of deep cryogenic processing include, for example, treatment of cutting tools to improve life and wear resistance, and treatment of firearm barrels and related components to improve accuracy and to extend barrel life. For instance, Paulin U.S. Pat. No. 5,865,913 et al. discloses a deep cryogenic tempering process for treating firearm barrels and components that provides a specific deep cryogenic processing flow and processing profile. Unfortunately, the processing flow and profile are specific to the firearm application and cannot be used for other applications due to the dependency of the process on the mass of the processing load and the materials treated. Furthermore, the processing flow and profile are also dependent on the specific structural properties to be achieved, i.e. improved accuracy of a firearm barrel.

Deep cryogenic tempering processes are highly dependent upon the components to be treated and the specific structural properties that are to be attained. New uses for deep cryogenic tempering have been developed based on newly discovered improvements in properties that were not known at the time, such as improving firearm barrel accuracy as disclosed in Paulin et al. Accordingly, a unique processing flow and profile for deep cryogenic tempering were required in Paulin et al. as a function of the particular application that were not known at the time, in order to develop the patented invention. Accordingly, the processing parameters are often a function of the component material, the geometrical properties of the component, and the mass of the component(s), among others, and must be determined for the specific application and desired set of structural properties, which are often not known or contemplated in the known art.

Although deep cryogenic tempering has been applied to a few specific applications, the process has not previously been contemplated for brake components such as rotors and drums. Due to the specific operating environment of brake components, the desired set of structural properties is unique. For example, warpage of brake rotors often occurs, wherein the warpage results from elevated temperatures and non-uniform pressures being applied to a rotor surface.

Brake components further exhibit a condition known as heat checking, wherein micro-fractures and cracks develop over the surface of the component, such as a rotor, which unfortunately results in an abrasive surface that increases the wear of brake pads and therefore significantly reduces service life. Another condition specific to brake components is fading, wherein a loss of brake performance or stopping ability occurs over a period of time. Other unfavorable conditions of brake components include heat build-up and cracking, which also reduce the service life of the components and contribute to increased safety risks.

Accordingly, there remains a need in the art for a deep cryogenic tempering process for brake components, including but not limited to, brake drums and rotors, wherein specific structural properties of the brake components are greatly enhanced. The deep cryogenic tempering process should result in improved warpage resistance, heat resistance, and service life, in addition to reduced heat checking, fading, and cracking, among other improvements in structural properties of brake components.

SUMMARY OF THE INVENTION

In one preferred form, the present invention provides a deep cryogenic tempering process for brake components to enhance certain structural properties, including but not limited to, reduced heat checking, fading, and cracking, in addition to improved warpage resistance, heat resistance, and service life. The deep cryogenic tempering process generally comprises first cooling the brake components to temperatures of approximately −300° F., followed by a gradual increase to approximately 300° F., and then finally a gradual cooling to ambient temperatures.

The temperature of the brake components is increased and decreased through several stages that include an initial descent stage to achieve a brake component temperature of approximately −300° F., a static stage to hold the −300° F. for a period of time, an ascent stage to achieve a brake component temperature of approximately 300° F. for a post temper, and a final cool-down stage to cool the brake components to ambient temperatures. The amount of time during and between each stage, and further the rate of temperature change during the descent, ascent, and cool-down stages are dependent upon brake component properties such as material type, total mass, and cross-sectional properties, among others.

Generally, the deep cryogenic process involves loading one or a plurality of brake components such as rotors, drums, or others, into a cryogenic processing chamber and introducing gaseous nitrogen into the chamber at a certain rate to lower the temperature of the brake components to approximately −300° F. Liquid nitrogen is first flashed into a gaseous form, rather than directly introducing liquid nitrogen, in order to minimize the risk of thermal shock to the brake components. Although the present invention preferably introduces gaseous nitrogen, other cryogenic compounds such as oxygen or hydrogen may also be used, depending on the specific material being treated, and thus the use of gaseous nitrogen shall not be construed as limiting the scope of the present invention.

After a period of time at approximately −300° F., hereinafter referred to as the stay time, the gaseous nitrogen is expunged from the chamber to bring the brake components to a temperature of approximately −100° F. The brake components are then transported to a tempering oven, wherein the temperature of the brake components is increased to approximately 300° F. and is held at 300° F. for a period of time, hereinafter referred to as a post temper time. Several post temper times may also be employed, and the present invention preferably employs a total of three (3) post temper times. Finally, the temperature of the brake components is reduced to ambient to complete the deep cryogenic tempering process.

In another preferred form, the present invention provides a brake component comprising an improved molecular structure as a result of the deep cryogenic tempering process. The improvements to the molecular structure, similar to the processing profile, are dependent upon the properties of the brake component such as the material type, total mass, and cross-sectional properties, among others. The improved molecular structure includes, for example, a certain transformation from austenite to martensite for components having a steel material type. Other improvements in molecular structure further depend on the component properties and the particular processing profile employed. As a result, the improved molecular structure enhances the structural properties of brake components as previously set forth.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

The following description of the preferred embodiments is merely exemplary in nature and is in no way intended to limit the invention, its application, or uses.

Figure 1:
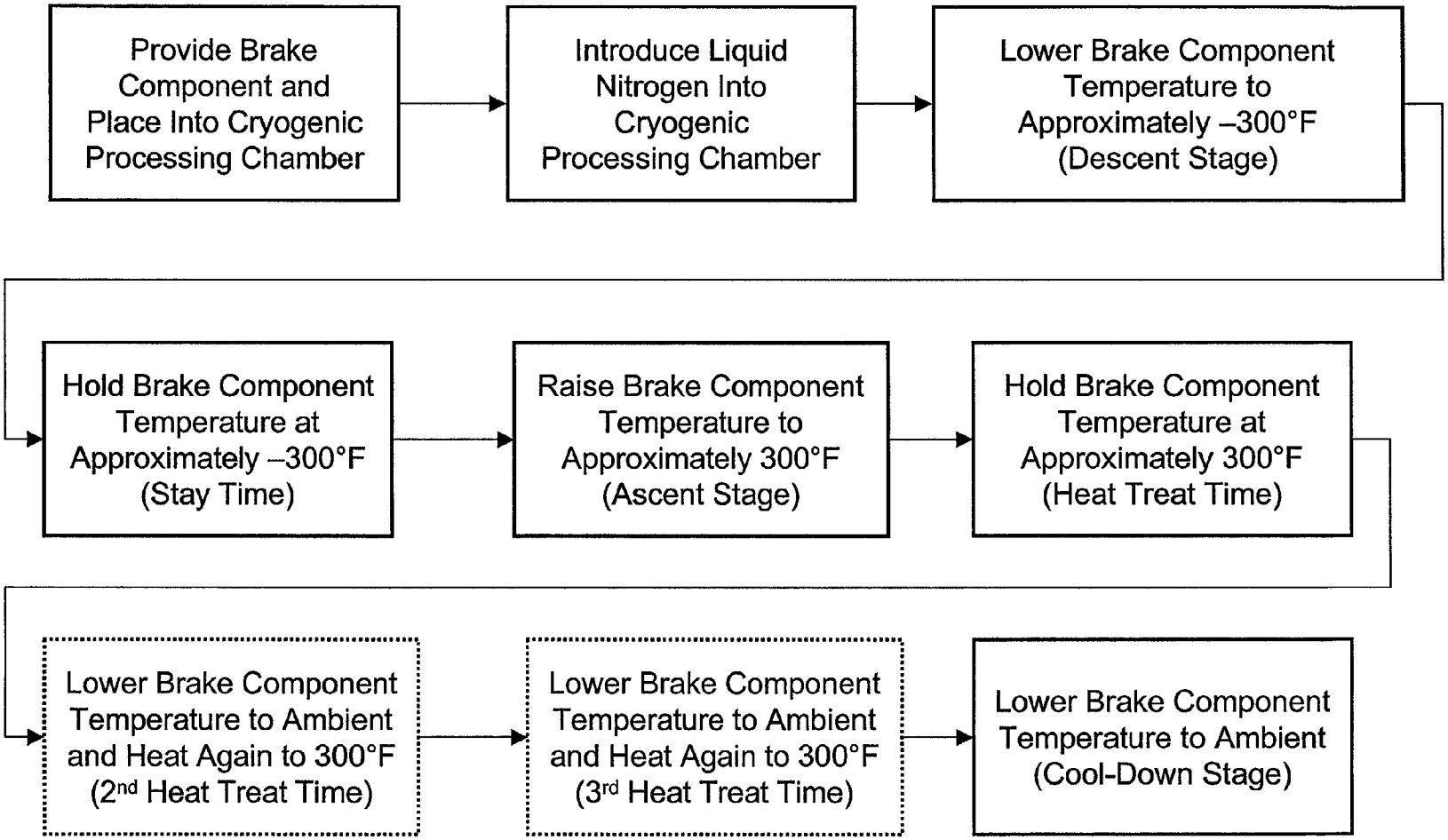
FIG. 1 is flow diagram illustrating the deep cryogenic tempering process in accordance with the methods of the present invention.

Referring to the drawings, a flow diagram for the deep cryogenic tempering process according to the present invention is illustrated in FIG. 1. As shown, one or a plurality of brake components are first loaded into a cryogenic processing chamber. It shall be appreciated by those skilled in the art that deep cryogenic processing equipment is known in the art, and therefore, a detailed description thereof is not included herein for purposes of clarity.

Preferably, the brake components are at a temperature of approximately 100 degrees F. when placed into the cryogenic processing chamber. Gaseous nitrogen is then introduced into the cryogenic processing chamber to decrease the temperature of the brake components to approximately −300° F. at a descent rate, wherein the descent rate is dependent on brake component properties such as material, mass, and geometrical cross-section. Generally, the time during which the temperature of the brake components is lowered to deep cryogenic levels is referred to as the descent stage.

Once the brake components reach approximately −300° F., the temperature of the components is held for a period of time referred to as the stay time. The stay time is also dependent on brake component properties such as material, mass, and geometrical cross-section.

After the stay time, the temperature of the brake components is raised to approximately 300° F. at an ascent rate, wherein the ascent rate is also dependent on brake component properties such as material, mass, and geometrical cross-section. Preferably, the gaseous nitrogen is expunged from the cryogenic processing chamber to first bring the temperature of the brake components to approximately −100° F. Once the temperature of the brake components is at approximately −100° F., the brake components are then transported to a tempering oven to raise their temperature to approximately 300° F. The stage during which the temperature of the brake components is raised to approximately 300° F. is referred to as the ascent stage.

Once the temperature of the brake components reaches approximately 300° F., the temperature is held for a period of time referred to as a post temper time, wherein the post temper time is also dependent on brake component properties such as material, mass, and geometrical cross-section. Preferably, the temperature of the brake components is reduced to ambient and increased again to 300° F. for a second post temper time, and further reduced to ambient and increased again to 300° F. for a third post temper time. As indicated by the dashed lines, however, the second and third post temper times are optional depending on the properties of the specific brake components.

After the post temper times, the temperature of the brake components is lowered to ambient during the final cool-down stage as illustrated. Similarly, the cool-down rate is also dependent on brake component properties such as material, mass, and geometrical cross-section. Once the brake components have cooled sufficiently, the components are removed from the tempering oven and are ready for use.

Figure 2:
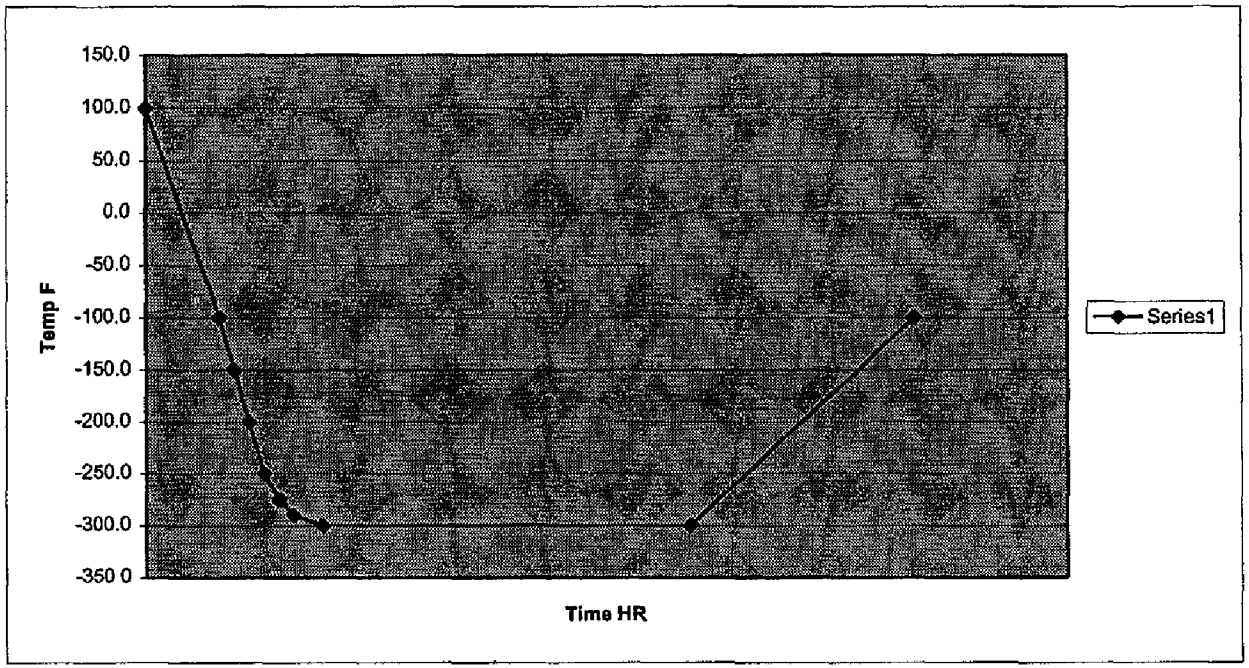
FIG. 2 is an exemplary processing profile for the descent stage, the stay time, and a portion of the ascent stage of the deep cryogenic tempering process in accordance with the methods of the present invention.

Specific times and temperatures that follow the flow diagram as illustrated in FIG. 1 are collectively referred to as a processing profile. An exemplary deep cryogenic processing profile for the descent stage, stay time, and a portion of the ascent stage for brake components having a specific material, mass, and cross-sectional area is shown in FIG. 2. Similarly, a continuation of the ascent stage along with exemplary post temper times are illustrated in FIG. 3, which include a total of three (3) post temper cycles prior to the cool-down stage in one form of the present invention.

Figure 3:
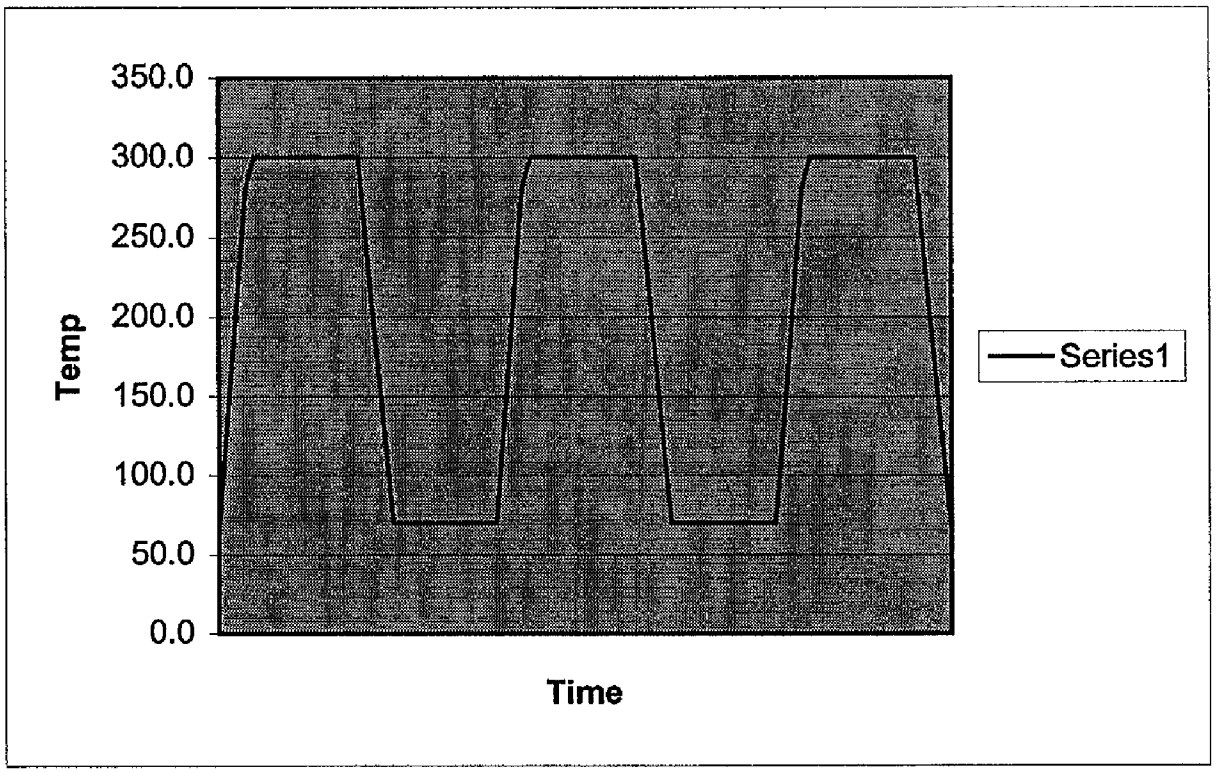
FIG. 3 is an exemplary processing profile for the post temper times in accordance with the methods of the present invention.

The profiles shown in FIGS. 2 and 3 are used for brake rotors having compositions such as SAE3000, SAE1800, GG25, and GG15. At an initial temperature of 100° F. with a total mass between 1,000-1,500 lbs. and a cross-sectional area greater than 4 inches: the descent rate is approximately 34.8° F. per hour; the stay time is 24 hours; the ascent rate is approximately 12° F. per hour; each of the post temper times is approximately one hour; and the cool-down rate is approximately 12° F. per minute. The example profile disclosed herein is intended for illustrative purposes only and should not be construed as limiting the scope of the claimed invention.

Additional processing profiles for the deep cryogenic tempering process depend on the material, mass, and geometrical cross-section of the brake components. Table I indicates appropriate descent rates, stay times, and ascent rates for brake components according to the present invention, wherein Profile 1 is used where the mass is approximately 0-500 lbs., Profile 2 is used where the mass is approximately 500-1,000 lbs., and Profile 3 is used where the mass is approximately 1,000-1,500 lbs. Accordingly, Profile 3 is illustrated in FIG. 2 as previously set forth. Furthermore, the post tempering process as illustrated in FIG. 3 is generally used for brake components having a mass according to each profile as shown below in Table I.

TABLE I

| Profile | Mass | Cross Section | Descent Rate | Stay Time | Ascent Rate |
|---|---|---|---|---|---|
| 1 | 0-500 lbs | <2 $in^2$. | ~25°/F. | ~17.0°/F. | ~8.0°/F. |
| 1 | 0-500 lbs | 2-4 $in^2$. | Go To Profile 2 | Go To Profile 2 | Go To Profile 2 |
| 1 | 0-500 lbs | >4 $in^2$. | Go To Profile 2 | Go To Profile 2 | Go To Profile 2 |
| 2 | 500-1,000 lbs. | <2 $in^2$. | Go To Profile 2 | Go To Profile 2 | Go To Profile 2 |
| 2 | 500-1,000 lbs. | 2-4 $in^2$. | ~29°/F. | ~20.5°/F. | ~10.0°/F. |
| 2 | 500-1,000 lbs. | >4 $in^2$. | Go To Profile 3 | Go To Profile 3 | Go To Profile 3 |
| 3 | 1,000-1,500 lbs. | <2 $in^2$. | Go To Profile 3 | Go To Profile 3 | Go To Profile 3 |
| 3 | 1,000-1,500 lbs. | 2-4 $in^2$. | Go To Profile 3 | Go To Profile 3 | Go To Profile 3 |
| 3 | 1,000-1,500 lbs. | >4 $in^2$. | ~35°/F. | ~24.0°/F. | ~12.0°/F. |

As a result of the deep cryogenic tempering process as described herein, substantial improvements in the performance of brake components are realized. For example, heat checking, fading, warping, and cracking are significantly reduced, heat dissipation is improved, and the service life and safety of brake components are greatly enhanced.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method for deep cryogenic tempering of metallic brake rotors, the method comprising the steps of:

(a) determining a mass and cross sectional area of the brake rotors;

(b) placing the brake rotors at a temperature within a cryogenic processing chamber;

(c) cooling the brake rotors at a descent rate, the descent rate being a function of the mass and cross sectional area of the brake rotors, until the temperature of the brake rotors is approximately −300° F., the cooling accomplished by introducing gaseous nitrogen into the cryogenic processing chamber;

(d) maintaining the brake rotors temperature at −300° F. for a stay time, the stay time being a function of the mass and the cross sectional area of the brake rotors;

(e) raising the temperature of the brake rotors to approximately 300° F. at an ascent rate, the ascent rate being a function of the mass and the cross sectional area of the brake rotors;

(f) maintaining the temperature of the brake rotors at 300° F. for a post temper time;

(g) lowering the temperature of the brake rotors to room temperature at a cool down rate;

(h) raising the temperature of the brake rotors to approximately 300° F. at an ascent rate;

(i) maintaining the temperature of the brake rotors at 300° F. for a post temper time; and (j) lowering the temperature of the brake rotors to room temperature at a cool down rate.

2. The method of claim 1, wherein steps (h), (i), and (j) are repeated for a third post temper time.

3. The method of claim 2, wherein:

the temperature of the brake rotors is approximately 100 degrees F. at step (b).

4. The method of claim 1 further comprising the step of:

raising the temperature of the brake rotors to approximately −100° F. within the cryogenic processing chamber after step (d) and before step (e).

5. The method of claim 1 further comprising the step of transporting the brake rotors to a tempering oven during step (f).

* * * * *